US007642735B2

(12) United States Patent
Gulsen et al.

(10) Patent No.: US 7,642,735 B2
(45) Date of Patent: Jan. 5, 2010

(54) USING PULSE DENSITY MODULATION FOR CONTROLLING DIMMABLE ELECTRONIC LIGHTING BALLASTS

(75) Inventors: John K. Gulsen, Aliso Viejo, CA (US); Stephen Bowling, Chandler, AZ (US)

(73) Assignee: Microchip Technology Incorporated, Chandler, AZ (US)

( * ) Notice: Subject to any disclaimer, the term of this patent is extended or adjusted under 35 U.S.C. 154(b) by 375 days.

(21) Appl. No.: 11/470,052

(22) Filed: Sep. 5, 2006

(65) Prior Publication Data

US 2008/0054825 A1 Mar. 6, 2008

(51) Int. Cl.
*H05B 37/02* (2006.01)
*H05B 41/36* (2006.01)

(52) U.S. Cl. ..... 315/360; 315/307

(58) Field of Classification Search ..... 315/291, 315/307, 209 R, 246, DIG. 1, DIG. 4, 244, 315/248, 360

See application file for complete search history.

(56) References Cited

U.S. PATENT DOCUMENTS

| | | | | |
|---|---|---|---|---|
| 5,440,324 | A | 8/1995 | Strickling, III et al. | |
| 5,811,942 | A * | 9/1998 | Pedretti | 315/312 |
| 6,002,213 | A * | 12/1999 | Wood | 315/307 |
| 6,094,016 | A * | 7/2000 | Luger et al. | 315/295 |
| 6,583,568 | B1 * | 6/2003 | O'Meara | 315/199 |
| 6,956,336 | B2 * | 10/2005 | Ribarich | 315/247 |
| 7,009,348 | B2 * | 3/2006 | Mogilner et al. | 315/307 |
| 2002/0140371 | A1 | 10/2002 | Chou et al. | |
| 2004/0217715 | A1 | 11/2004 | Yang et al. | |
| 2004/0263093 | A1 | 12/2004 | Matsubayashi et al. | |
| 2005/0047176 | A1 | 3/2005 | Fukumoto | |
| 2006/0126365 | A1 | 6/2006 | Chou et al. | |

FOREIGN PATENT DOCUMENTS

EP 1 401 091 A1 6/2002

OTHER PUBLICATIONS

Communication Relating to the Results of the Partial International Search for PCT/US2007/077200 mailed Jan. 25, 2008.

* cited by examiner

*Primary Examiner*—Douglas W Owens
*Assistant Examiner*—Minh D A
(74) *Attorney, Agent, or Firm*—King & Spalding L.L.P.

(57) ABSTRACT

Pulse Density Modulation (PDM) is used to control the amount of light from a fluorescent lamp by applying a voltage to the lamp filaments at a low frequency that is approximately at a series resonant frequency of the lamp ballast inductor and the lamp filament capacitor, no voltage and a voltage at a high frequency. The lamp gas ionizes to produce light only when the low frequency voltage is applied. The fluorescent lamp gas does not ionize when the voltage at the high frequency is applied, but the high frequency voltage keeps the lamp filaments warm during low light output conditions. The low frequency, no and high frequency voltages have time periods that occur within a modulation frame time period that repeats continuously. The ratio of the low frequency voltage time period, and the no voltage and/or high frequency voltage time periods determine the light output of the fluorescent lamp.

26 Claims, 7 Drawing Sheets

USING PULSE DENSITY MODULATION FOR CONTROLLING DIMMABLE ELECTRONIC LIGHTING BALLASTS

TECHNICAL FIELD

The present disclosure relates to dimmable fluorescent lighting, and more particularly, to using pulse density modulation for controlling electronic lighting ballasts of the dimmable fluorescent lighting.

BACKGROUND

A typical resonant circuit fluorescent lighting ballast and fluorescent lamp are shown in FIG. 1. Operation may be understood by representing this circuit as two equivalent resistor-inductor-capacitor (RLC) circuits. The first equivalent circuit, shown in FIG. 2, is series resonant at a particular frequency, typically about 70 kHz, the series resonance of the inductor 710 and the filament capacitor 716 (Cf). The second equivalent circuit is shown in FIG. 3. Note that in both equivalent circuits the capacitor 714 (C) has been replaced by a short circuit (zero resistance). The function of the capacitor 714 is to perform DC blocking (allowing only AC signals through the circuit) and is chosen to have a high value of capacitance for this purpose. It is modeled to be a short (low impedance connection at the AC signal frequencies) in these equivalent circuits.

When the fluorescent lamp is off, the ballast is first driven at frequency, $F_{High}$. This frequency is chosen to be above the resonant frequency point of the RLC circuit, and is typically about 100 kHz. At this frequency, FIG. 2 best represents the lamp's equivalent circuit since the lamp gas has not yet ionized. The frequency response of the circuit with respect to the current is shown in FIG. 4. The purpose here is to run current through the filaments of the lamp, this is typically referred to as the 'Preheat' interval. When the filaments are warm enough to ionize the surrounding lamp gas, the drive frequency is lowered. This causes the RLC circuit to be swept through its resonant frequency, causing an increase in the voltage across the lamp. An arc will occur in the lamp at its 'strike' voltage and the arc will ignite (ionize) the gas.

Lamp 'ignition' means that the gas is now ionized enough to conduct an electric current. The lamp is now said to be on (producing visible light). At this point, FIG. 3 best describes the behavior of the lamp ballast circuit. Note that the lamp now behaves as an L in series with a parallel R and Cf. The R in this case is the electrical resistance of the ionized gas in the lamp and Cf is the filament capacitance 716. The frequency response of the circuit with respect to lamp current is shown in FIG. 5. Note that while the gas in the lamp is ionized, the current increases as the drive frequency is decreased. There is a point on the frequency response curve where the current is pinched off. Note that this point can be selectable by the ballast designer by manipulating the values of L and Cf.

While the lamp is on, it will be driven at a frequency, $F_{Low}$. The ballast designer may choose this drive frequency as optimal for the specified wattage of the fluorescent lamp. If the drive frequency is increased, that is the RLC circuit is detuned, the lamp will start to dim. As FIG. 5 shows, the current though the gas in the lamp will decrease and so the light output will decrease with the decrease in current. As the drive frequency is increased, at some point between $F_{Low}$ and $F_{High}$, the lamp will go out as the lamp current gets 'pinched' off.

There are a number of state of the art analog techniques in the literature and on the market that make use of the above mentioned effects. Dimming is accomplished by modulating the drive frequency to the RLC circuit.

The industry standard method of modulating the drive frequency is with an analog voltage controlled oscillator (VCO). A DC voltage is fed into the Modulator Input of the VCO and a square wave signal is generated. The device identified as 'Logic Block' in FIGS. 1 through 3, converts the square wave into two drive signals on the gates of the power MOSFET transistors. A typical implementation of this circuit is shown in FIG. 6.

The frequency resolution of the VCO is important. FIG. 5 shows that the relationship between the drive frequency and the lamp current is not linear, rather it is more in the shape of an 'S' curve. This makes the light output response of the lamp difficult to control without the use of more sophisticated circuitry. Many implementation of this sort of control system are on the market today.

Note that the steepest slope on the curve is close to its 'pinch off' point (around 60 kHz in FIG. 5). In this frequency band, small changes in frequency yield large changes in brightness. The method of dimming the lamp in this classic fluorescent lamp resonant circuit involves modulating the drive frequency. That is, as the frequency is raised linearly, the lamp brightness is lowered exponentially. This effect is not tolerant to coarse frequency modulation signals, especially at these low brightness levels. If the granularity of frequency control is too large, stepping from one frequency to another will result in a very visible brightness change; i.e., the lamp brightness is quantized.

Another challenge to the classic analog drive methods occur on all dimming ballast circuits at low brightness levels. The filaments of the lamp need to stay warm so as to ionize their surrounding gas. When little current flows through the lamp, the filaments cool and the lamp goes out. More complex drive circuits are needed to provide DC (or AC) bias to the filaments to keep them warm and thus compensate for this effect. There are many examples of this type of compensation in the literature. They all tend to add more components and complexity to the ballast design.

Feedback control is needed with this circuit solution. Whenever the lamp's temperature changes, its luminescence changes. So at a particular, constant drive frequency, the lamp brightness will vary until it reaches thermal equilibrium. A feedback control loop is typically employed so as to monitor the lamp current. As the lamp temperature changes, so will the current through the lamp. The drive frequency is adjusted continuously so as to maintain constant brightness, e.g., constant lamp current.

A much worst effect can also happen on cool filaments leading to their premature failure. When the current through the lamp is low, a 'hot spot' can develop on a filament. The lamp current will concentrate its flow into this small area on the filament where the gas is well ionized. Continued, differential, thermal stress on this small area of the filament can cause an open circuit there. Running current through the filament will evenly heat the entire filament, and thereby distribute the lamp current across the filament's entire length. Since all of the filament will be hot and have ionized gas around it, lamp current will not concentrate at any small spots.

SUMMARY

Therefore when utilizing a dimmable electronic ballast the following features are desired: (1) A way of varying the brightness of the lamp that compensates for thermal effects on the lamp. (2) Adequate resolution in the dimming circuit so brightness changes are smooth to the human eye and not visibly quantized. (3) 'Preheat' capability where the gas in the lamp is partially ionized and able to ignite without causing hot-spots to form on the filament. And (4) filament bias capability where the filaments are kept warm at low brightness levels to keep the lamp from going out and to prevent the filaments from developing 'hot spots.'

Present technology analog and mixed signal techniques have been the only commercially successful design topologies used in the fluorescent lighting industry for dimmable electronic ballasts. The present technology dimmable electronic ballasts require many passive components to implement and have all the drawbacks of component tolerance, temperature drift and lifetime endurance associated with analog electronic components.

In contrast, digital electronic solutions offer the lighting industry precise and dependable control of their fluorescent lamp circuits. The operational performance of a digital component doesn't drift with temperature. The accuracy of digital logic is dependent upon the quality of its clock source, e.g., modern crystals and resonator devices are highly reliable, accurate and inexpensive. Since the performance of digital circuits don't change or worst case change insignificantly with age, their lifetime endurance may be higher.

According to teaching of this disclosure, specific example embodiments representing digital solutions for driving a dimmable fluorescent lamp will be disclosed herein. According to the teachings of this disclosure, no voltage-controlled oscillator (VCO) is required, and thus, the difficulties of prior technology VCO analog circuits may be avoided, while providing all of the aforementioned desirable features. It is contemplated and within the scope of this disclosure that a digital device, e.g., microprocessor, microcontroller, application specific integrated circuit (ASIC), programmable logic array (PLA), etc., may be used for driving the power MOSFETs, and the aforementioned features may be implemented with a software program(s), firmware, etc., controlling operation of the digital device and/or hardware internal and/or external to the digital device.

The use of an inexpensive digital device, e.g., a microcontroller, in fluorescent lighting dimming control has many advantages. Since the functionality of the microcontroller may be dependent upon the software running in the microcontroller, lighting features may be implemented easily and inexpensively. The feature set required by a particular fluorescent dimming application may be custom tailored by the lamp manufacturer quickly and easily through custom software programming of the digital device, e.g., microcontroller.

According to a specific example embodiment of this disclosure, a method for controlling dimmable electronic lighting ballasts using pulse density modulation may comprise the steps of: generating a low frequency for a first time period, wherein the low frequency is approximately at a circuit resonant frequency of a dimmable electronic lighting ballast and a fluorescent lamp; and generating no frequency for a second time period; wherein the first and second time periods are within a modulation frame time period and the modulation frame time period that repeats continuously.

According to another specific example embodiment of this disclosure, a method for controlling dimmable electronic lighting ballasts using pulse density modulation may comprise the steps of: generating a low frequency for a first time period, wherein the low frequency is approximately at a circuit resonant frequency of a dimmable electronic lighting ballast and a fluorescent lamp; generating no frequency for a second time period; generating a high frequency for a third time period, wherein the high frequency is above the circuit resonant frequency of the dimmable electronic lighting ballast and the fluorescent lamp; wherein the first, second and third time periods are within a modulation frame time period and the modulation frame time period that repeats continuously.

According to yet another specific example embodiment of this disclosure, a dimmable fluorescent lamp system having an electronic lighting ballast using pulse density modulation for controlling the amount of light produced by the fluorescent lamp may comprise: a digital device having a first output and a second output; a first power switch having a control input coupled to the first output of the digital device; a second power switch having a control input coupled to the second output of the digital device; an inductor coupled to the first and second power switches, wherein the first power switch couples the inductor to a supply voltage, the second power switch couples the inductor to a supply voltage common, and the first and second power switches decouple the inductor from the supply voltage and supply voltage common, respectively; a direct current (DC) blocking capacitor coupled to the supply voltage common; a fluorescent lamp having first and second filaments, wherein the first filament is coupled to the inductor and the second filament is coupled to the DC blocking capacitor; and a filament capacitor coupling together the first and second filaments of the fluorescent lamp; wherein the digital device: generates a low frequency signal for a first time period, the low frequency being approximately at a series resonant frequency of the inductor and the filament capacitor, and generates no signal for a second time period, wherein the first and second time periods are within a modulation frame time period and the modulation frame time period repeats continuously.

BRIEF DESCRIPTION OF THE DRAWINGS

A more complete understanding of the present disclosure thereof may be acquired by referring to the following description taken in conjunction with the accompanying drawings wherein.

Figure 1:
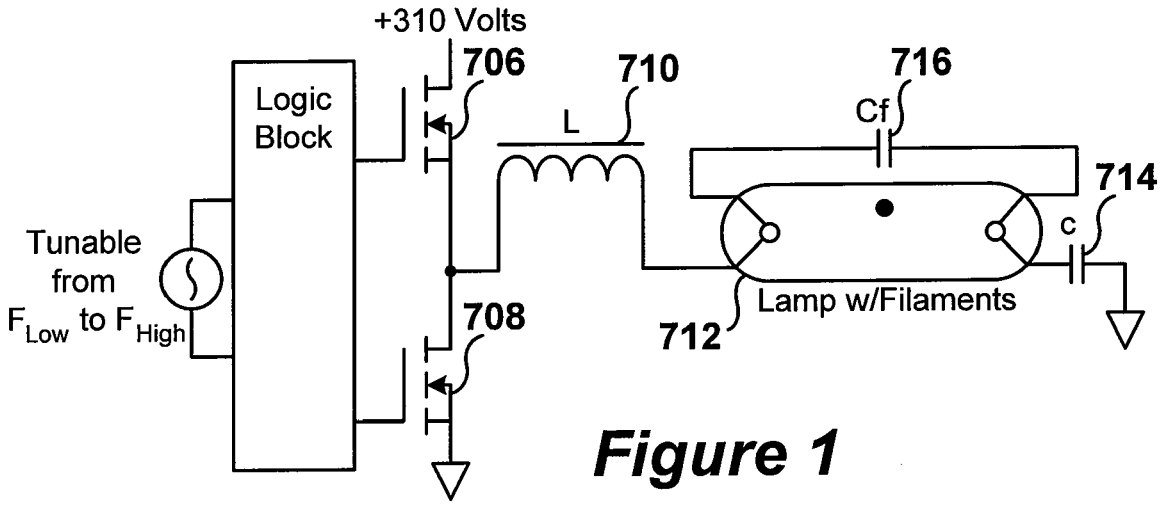
FIG. 1 illustrates a schematic diagram of a typical resonant circuit fluorescent dimmable lighting ballast and fluorescent lamp circuit.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

Referring now to the drawings, the details of specific example embodiments are schematically illustrated. Like elements in the drawings will be represented by like numbers, and similar elements will be represented by like numbers with a different lower case letter suffix.

Figure 7:
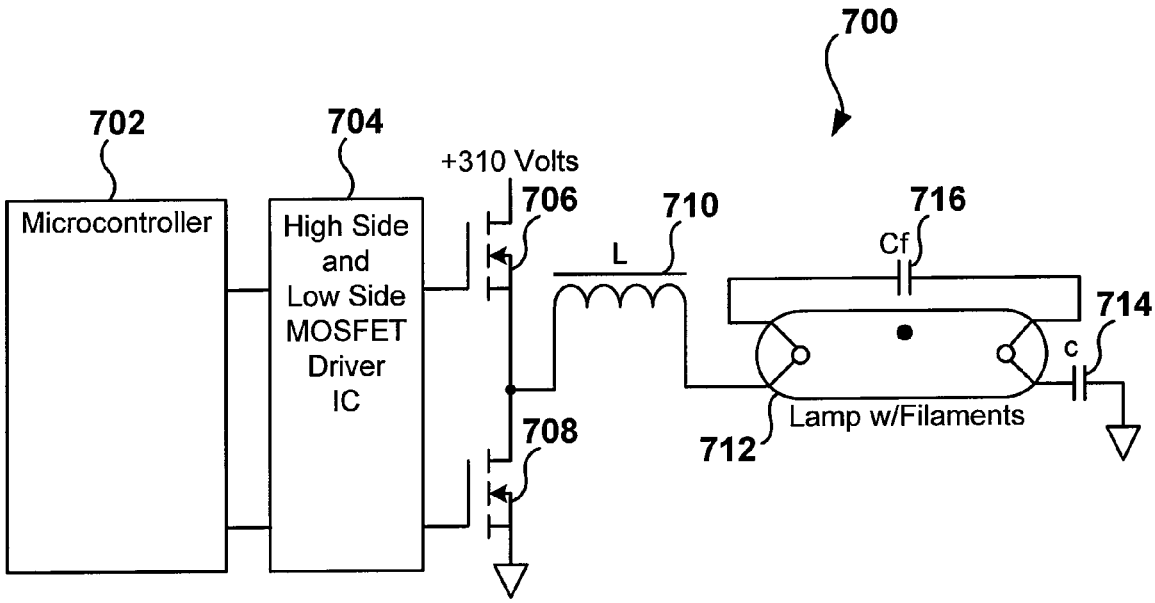
FIG. 7 illustrates a schematic diagram of pulse density modulation fluorescent lamp dimming circuit, according to a specific example embodiment of this disclosure.

According to teachings of this disclosure, a pulse density modulation technique for dimming a fluorescent lamp may be implemented by using an integrated circuit digital device, e.g., microcontroller integrated circuit. Referring now to FIG. 7, depicted is a schematic diagram of pulse density modulation fluorescent lamp dimming circuit, according to a specific example embodiment of this disclosure. The pulse density modulation fluorescent lamp dimming circuit, generally represented by the numeral 700, may comprise a microcontroller 702, a high and low side metal oxide semiconductor field effect transistor (MOSFET) driver 704, a high-side power MOSFET 706, a low-side power MOSFET 708, an inductor 710, a fluorescent lamp 712, a filament capacitor 716, and a DC blocking capacitor 714. The MOSFET driver 704 may be used to translate the low output voltages of the microcontroller 702 to the high voltage levels required to operate the high side power MOSFET 706 and the low side power MOSFET 708. The microcontroller 702 may be used to switch the high-side driver ON or OFF, and the low-side drive OFF or On, respectively, of the MOSFET driver 704. When the high-side drive is ON the high-side power MOSFET 706 allows current to flow through the resonant RLC fluorescent lamp circuit (inductor 710 and DC blocking capacitor 714) in one direction, and when the low-side drive is ON the low-side power MOSFET 708 allows current to flow through the resonant RLC fluorescent lamp circuit (inductor 710, fluorescent lamp 712 and DC blocking capacitor 714) in the other direction. The high-side power MOSFET 706 and the low-side power MOSFET 708 cannot be both ON at the same time. Also a dead band is desirable, e.g., the high-side power MOSFET 706 and the low-side power MOSFET 708 are both OFF. This may be easily accomplished with software instructions running in the microcontroller 702. The microcontroller 702 may synthesize an alternating current (AC) signal by alternatively turning on the high-side and low-side outputs of the MOSFET driver 704. By carefully controlling the time duration of the high-side and low-side outputs of the MOSFET driver 704, an AC drive signal having a specific frequency may be synthesized.

Figure 8:
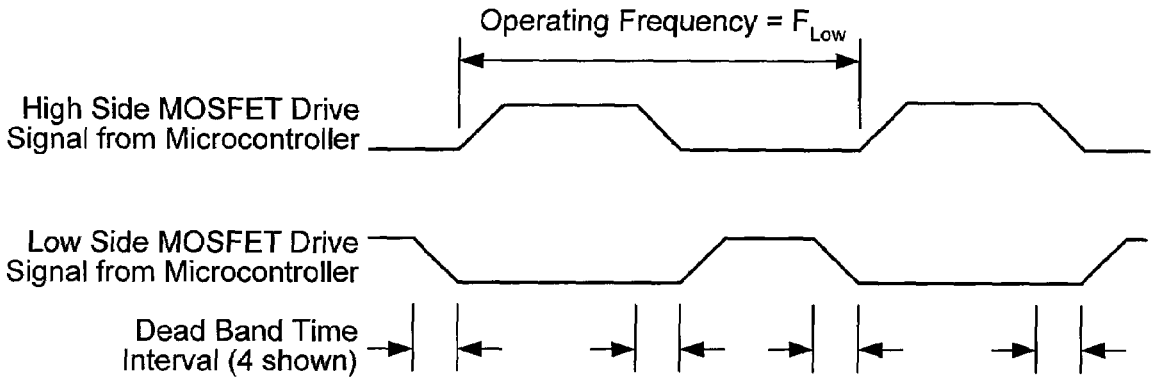
FIGS. 8 and 9, illustrate schematic waveform timing diagrams for low and high operating frequencies, $F_{Low}$ and $F_{High}$ respectively, according to a specific example embodiment of this disclosure.
Figure 9:
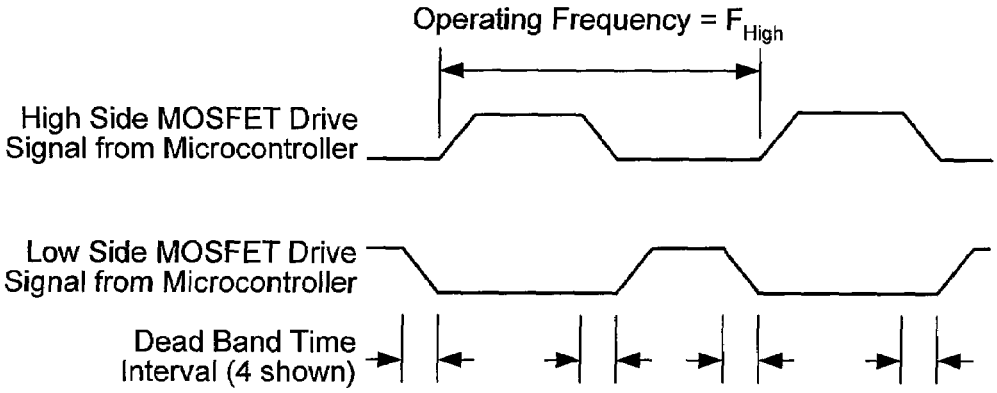

Referring now to FIGS. 8 and 9, depicted are schematic waveform timing diagrams for low and high operating frequencies, $F_{Low}$ and $F_{High}$ respectively, according to a specific example embodiment of this disclosure. FIG. 8 shows the low operating frequency waveform, $F_{Low}$, and FIG. 9 shows the high operating frequency waveform. When the high side drive signal is high, the low side drive signal is low, and visa-versa. There is a dead band time where both the high side and the low side drive signals are low. These waveforms may be used to synthesize the following frequencies: $F_{Low}$, $F_{High}$ and a DC signal (no current flow) when the high-side power MOSFET 706 and the low-side power MOSFET 708 are both off.

The signals generated by the microcontroller 702 are effectively square waves with a duty cycle of, for example but not limited to, 50 percent. An alternative description of these AC signals is that of a pulse train. Within an interval of time, the actual number of these 'pulses' can be measured. A 'high' frequency signal will have more pulses in a given time interval than a 'low' frequency signal. An alternate method of measuring these signals is by their pulse density. At a fixed duty cycle, a high frequency signal has high pulse density; a low frequency signal has low pulse density.

Varying the pulse density of a signal is known as "Pulse Density Modulation" (PDM). The three synthesized frequencies referenced hereinabove may be defined as PDM states as follows: (1) $State_{Off}$, (2) $State_{Low}$, and (3) $State_{High}$. For both of the active waveform states shown in FIGS. 8 and 9, i.e., $State_{Low}$ and $State_{High}$, respectively, there is a dead band interval between level transitions of the MOSFET drive signals from the microcontroller 702. This dead band interval assures that the currently active power MOSFET is given a sufficient amount of time to turn off before the complimentary power MOSFET is driven on. Dead-banding is a common technique that may be performed via the software running on the microcontroller 702. For example, each cycle in $State_{Low}$ and $State_{High}$ is initiated by the assertion of the 'high-side' driver, followed by its de-assertion; then a dead band time interval, next the 'low-side' driver is asserted, and followed by its de-assertion. This cycle sequence repeats for the duration of these PDM states.

According to the teachings of this disclosure, Pulse Density Modulation (PDM) may be used to achieve the aforementioned requirements (desired features) of a dimmable fluorescent lamp circuit. These requirements were stated previously and are repeated herein: (1) Vary the brightness of the fluorescent lamp so that thermal effects on the fluorescent lamp are compensated. (2) Obtain adequate resolution in the dimming circuit so brightness changes are smooth to the human eye and not visibly quantized. (3) 'Preheat' the filaments until the gas in the fluorescent lamp is partially ionized and able to ignite. And (4) maintain filament temperature at low brightness levels to keep the fluorescent lamp from going out and to prevent the filaments from developing 'hot spots.'

Preheat

At lamp power-up, it is important for both of the power MOSFETs 706 and 708 to be OFF, so the dimmer control system is initially in $State_{Off}$. The dimmer control system is then subsequently brought into $State_{High}$. At this state the dimmer control system is best represented as the equivalent circuit shown in FIG. 2, and the filaments will have current passing through them, e.g., the fluorescent lamp is undergoing 'Preheating.' The dimmer control system may be kept in $State_{High}$ for a time deemed sufficient to warm the filaments to their 'Strike' temperature. The amount of time required for a particular dimmer control system to stay in $State_{High}$ will be a function of the physics of that particular fluorescent lamp, and is known to one skilled in fluorescent lamp technology.

The lamp gas may now be ignited by having the dimmer control system enter the $State_{Off}$. The filaments are now hot after the 'Preheat' interval. The last 'high-side' cycle of $State_{High}$ forced current into the inductor 710 of the RLC circuit. The assertion of the 'low-side' cycle only allows a path for current to flow. The inductor cannot allow current to instantaneously cease flowing so the voltage across the lamp will build until the gas 'strikes.'Once ignition occurs, FIG. 3 best represents the equivalent RLC circuit, at this point the fluorescent lamp is said to be 'lit.' Note that the time needed for this 'strike' to occur is very short, e.g., it is short enough to occur within the 'low-side' assertion interval.

Controlled Lamp Brightness and Thermal Compensation

Figure 3:
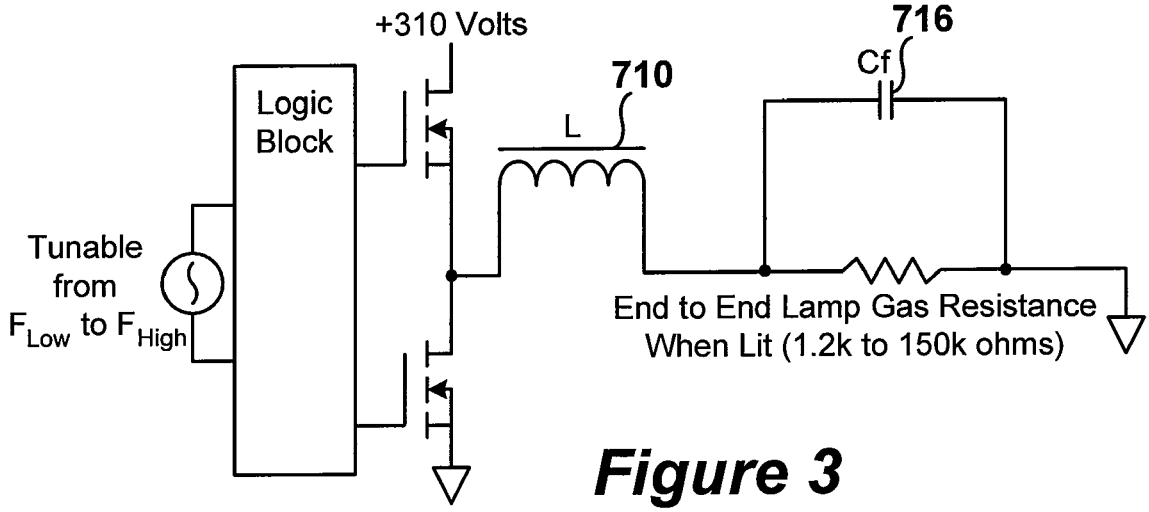
FIG. 3 illustrates a schematic diagram of an equivalent circuit of FIG. 1 wherein the fluorescent lamp gas has ionized and current is flowing therethrough.
Figure 4:
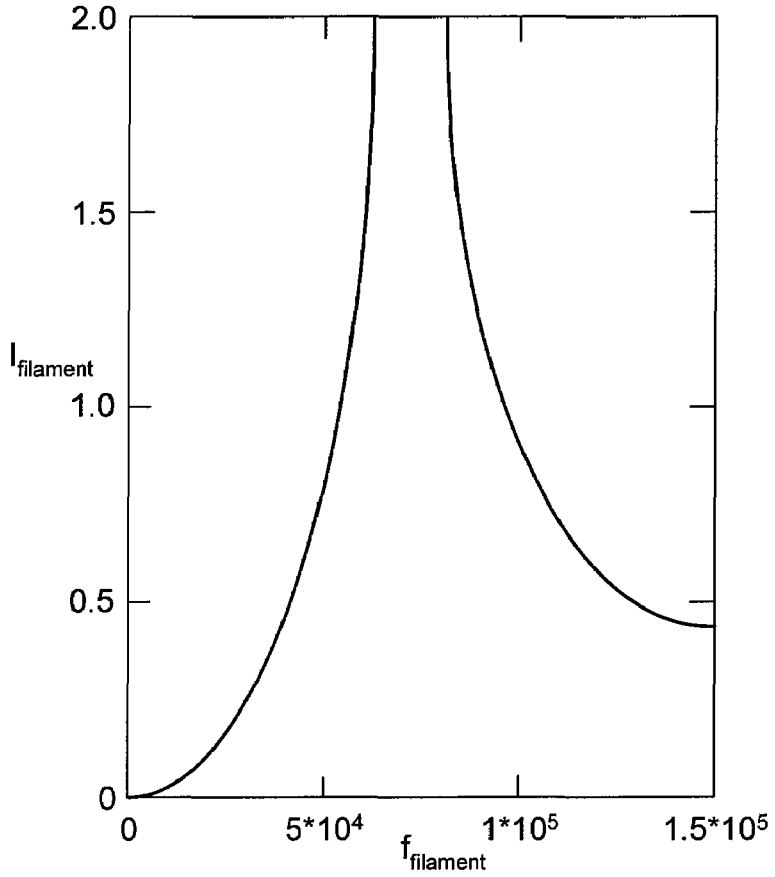
FIG. 4 illustrates a frequency versus current response of a fluorescent lamp circuit before gas ionization.
Figure 5:
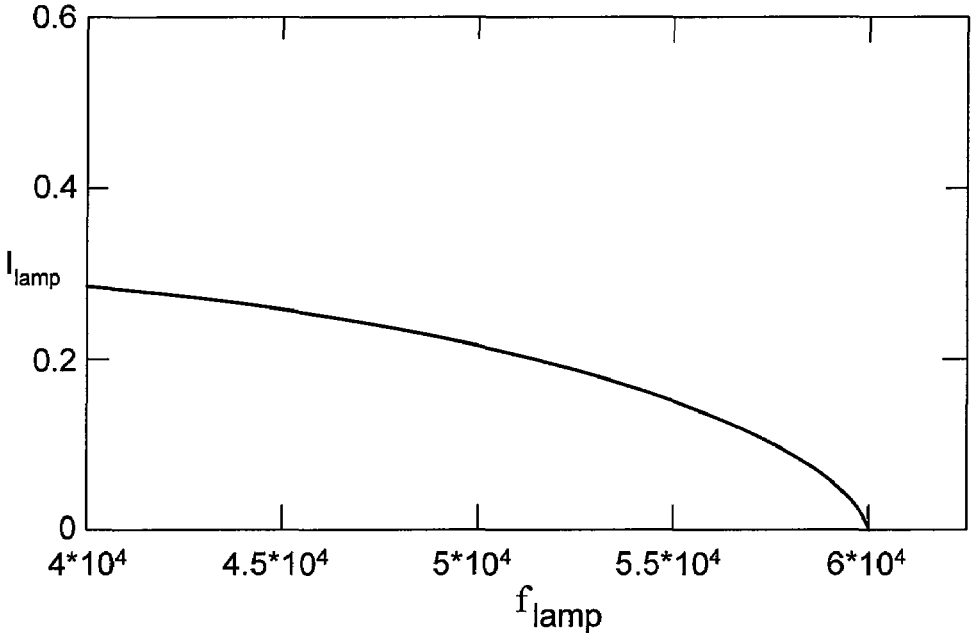
FIG. 5 illustrates a relationship between the drive frequency and the fluorescent lamp current.
Figure 6:
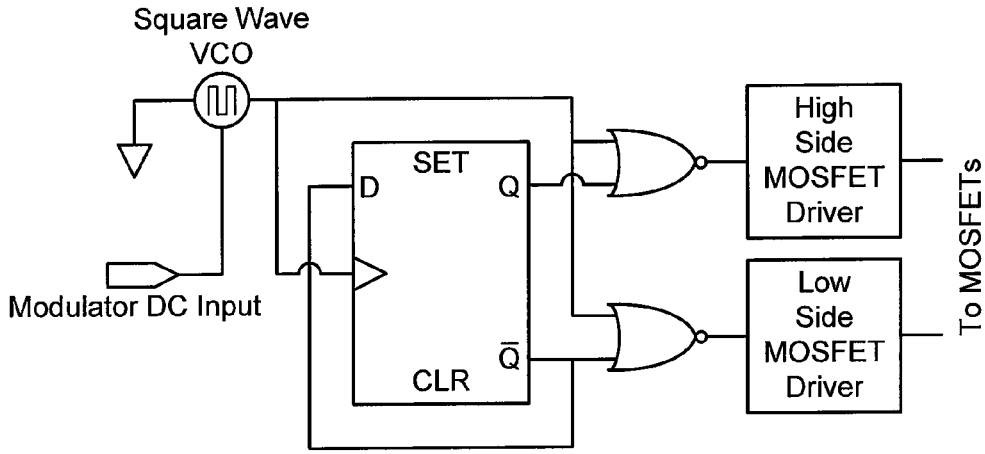
FIG. 6 illustrates a schematic diagram of a typical circuit for converting a square wave into two drive signals to turn on and off the power MOSFETs.

When the lamp 712 is commanded to be at full brightness, the dimmer control system shall be constantly in $State_{Low}$. In this PDM state, the dimmer control system is at a constant pulse density and it's equivalent circuit is best modeled as shown in FIG. 3. That is, when lit and running, and when commanded to be at full brightness, the power MOSFETs 706 and 708 are driven only at the $State_{Low}$ frequency.

Conversely, when commanded to be off, the dimmer control system is held in $State_{Off}$, where the lamp RLC circuit is not driven at any frequency. Actually, it is not driven at all. Note that there are actually two states where there is substantially no lamp gas current, e.g., lamp gas is non-conducting. This no lamp gas current condition is when the lamp is being driven during $State_{High}$ and $State_{Off}$. Only $State_{Low}$ causes current through the lamp gas.

When commanded to be at some middle brightness, the system may be modulated between the $State_{Low}$ and $State_{Off}$ states. That is, when lit and running, the dimmer control system is brought from a full brightness state to a fully off state and back. The ratio between the $State_{Off}$ and $State_{Low}$ durations determines the apparent brightness of the lamp to the eye.

Modulation of the pulse density needs to be at a rate faster than the human eye can notice. Typically, the human eye will notice flicker at a rate slower than about 30 Hz. If the modulation rate were much higher than this, flicker would not be an issue. For example, experimentation with modulation rates around 300 Hz has resulted in no noticeable flicker in either helical compact or linear fluorescent lamp tubing. Therefore, modulating the pulse density of the lamp drive signals can control the apparent brightness of the lamp by toggling between the $State_{Low}$ and $State_{Off}$ states and controlling the amount of time spent in each of these states.

Figure 2:
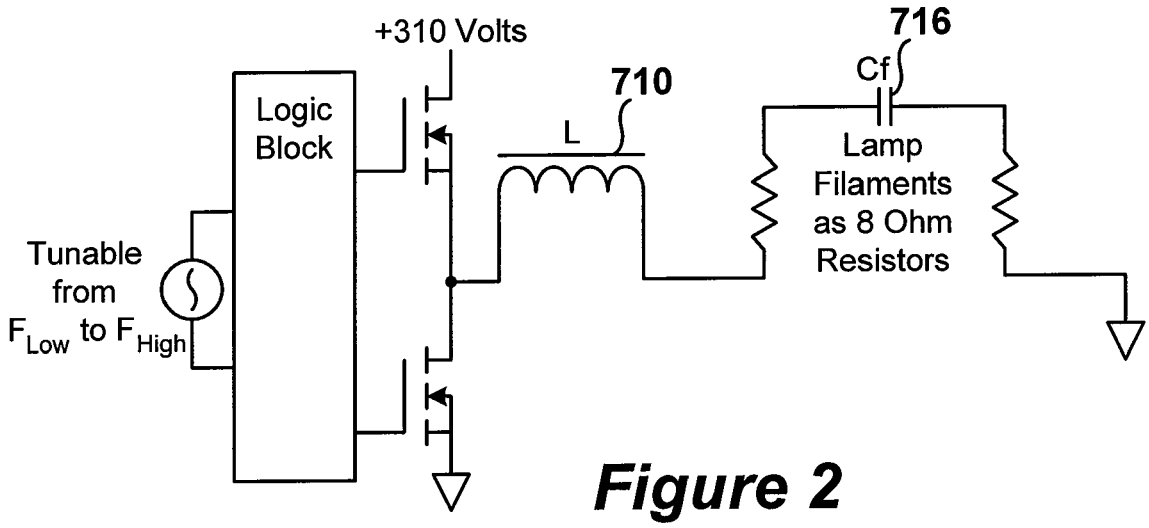
FIG. 2 illustrates a schematic diagram of an equivalent circuit of FIG. 1 wherein the fluorescent lamp gas has not yet ionized.
Figure 10:
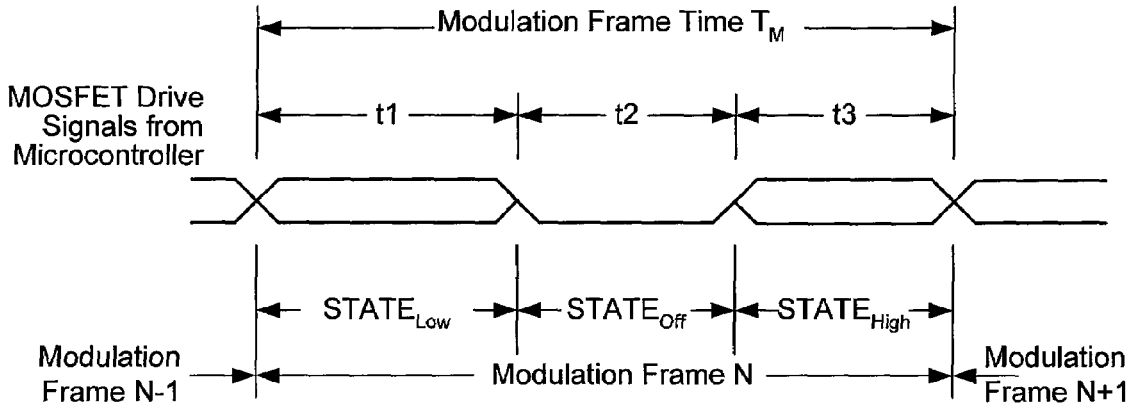
FIG. 10 illustrates a timing diagram of a 'Modulation Frame' that may be used to dim the lamp as well as maintain filament temperature, according to a specific example embodiment of this disclosure.

Maintaining filament temperature so that no hot spots will develop may be accomplished by dividing the time that the lamp gas is not ionized, e.g., when in the $State_{Off}$ or $State_{High}$ states. Referring now to FIG. 10, depicted is a timing diagram of a 'Modulation Frame' that may be used to dim the lamp as well as maintain filament temperature, according to a specific example embodiment of this disclosure. FIG. 10 shows the two MOSFET drive signals together for the purpose of clarity. There is one complete modulation frame shown and two partial ones to either side of it in time. The entire frame time is preferably less than one thirtieth of a second to avoid flicker, i.e., $1/30$ is greater than or equal to t1+t2+t3 (Equation 1). Where time interval t1 is the duration of $State_{Low}$, time interval t2 is the duration of $State_{Off}$, and time interval t3 is the duration of $State_{High}$. During t1, the lamp is driven at full brightness as it is currently in $State_{Low}$. In both the t2 and t3 intervals, the lamp is driven Off. Interval t2 has the lamp not driven at all. Interval t3 has the lamp circuit in $State_{High}$. When in the $State_{High}$ state, FIG. 2 shows the appropriate equivalent circuit for the dimmer control system, and current is sent through the filaments, but the lamp gas is not ionized.

An Apparent Brightness Duty Cycle (ABDC) may be defined herein as:

$$ABDC=t1/(t1+t2+t3) \quad \text{(Equation 2)}$$

The ABDC value, as with other Duty Cycle calculations may be expressed as a percentage. Thus, 100% ABDC means that the lamp is fully on (maximum brightness). A 0% ABDC means the lamp is fully Off (no light). A mid-percentage value of ABDC, e.g., 50%, means the lamp is driven fully on half the time and is left off the other half of the time.

The Maximum Lamp Power (MLP) may be defined herein as the wattage when the lamp is run at 100% ABDC. The MLP is a function of the physics of the lamp and is well know to those having ordinary skill in the art of fluorescent lamps. What is important to know is that there is a specified maximum power value for the lamp(s) when it is driven at its low frequency value ($F_{Low}$).

The Maximum Filament Power (MFP) may be defined herein as the wattage when the lamp is run in $State_{High}$ continuously. The MFP is a function of the electrical resistance of the lamp filament and the choice of L and Cf, it is not important to this disclosure. Suffice it to say that there is a theoretical maximum power value for the lamp filament when it is driven at its high frequency value ($F_{High}$).

The Resultant Lamp Power (RLP) and the Resultant Filament Power (RFP) may be defined herein as:

$$RLP=ABDC*MLP \quad \text{(Equation 3)}$$

$$RFP=t3/(t1+t2+t3)*MFP \quad \text{(Equation 4)}$$

Wherein the RLP is a measure of the lamp's luminous power and is expressed in Watts. The RFP is a measure of the filament's thermal power and is also expressed in Watts.

When the system is run at low Resultant Lamp Power (RLP), a certain Resultant Filament Power (RFP) level must be maintained. The reason for this is more fully described hereinabove (e.g., filament hot spots and loss of gas ionization). At low lamp power levels there is a tendency for the lamp to cool and go out. Also, the possibility of damaging filament hot spots developing goes up at low lamp temperatures.

The exact amount of RFP required for a given lamp design driven at a certain RLP will depend on the physics of that lamp and is not part of this disclosure. However, according to specific example embodiments of this disclosure, a lamp filament will be able to maintain its minimum operating temperature through the use of software program steps running on the digital device. Thus, there is no need to incorporate any added circuitry to bias the filaments so as to maintain a certain desired temperature thereon.

Brightness Stability and Feedback Control

Figure 11:
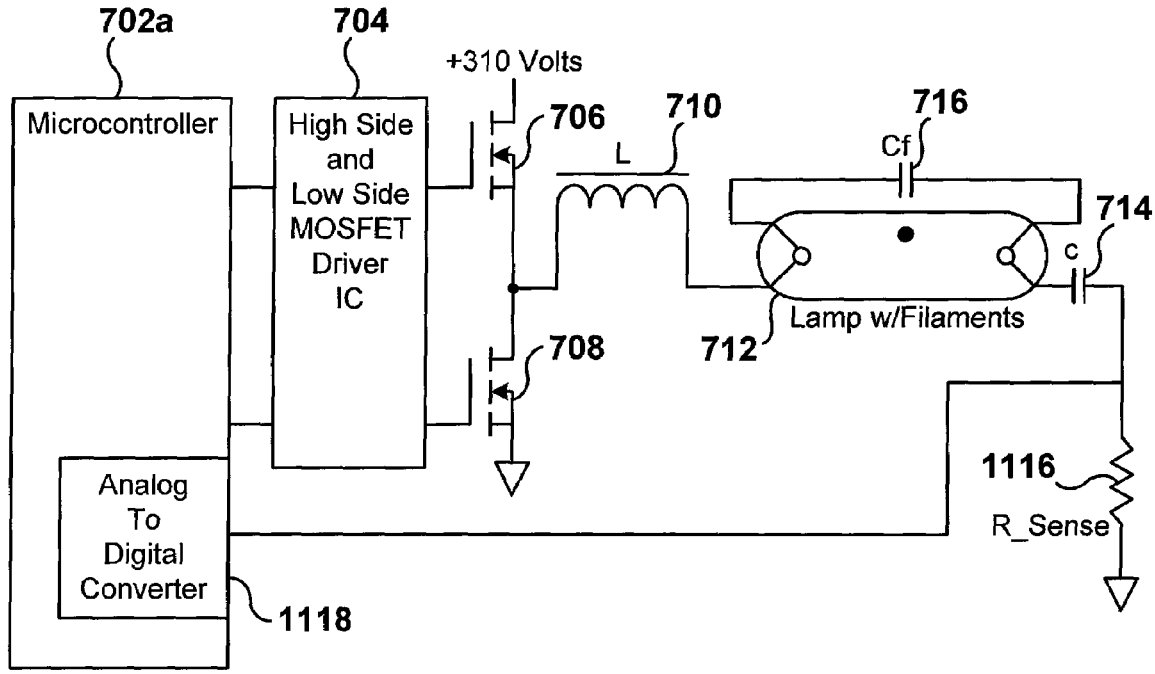
FIG. 11 illustrates a schematic diagram of the fluorescent lamp circuit of FIG. 7 with a current sense resistor, according to another specific example embodiment of this disclosure.

Referring now to FIG. 11, depicted is a schematic diagram of the fluorescent lamp circuit of FIG. 7 with a current sense resistor, according to another specific example embodiment of this disclosure. When a sense resistor 1116 is added to the circuit of FIG. 7, feedback control of the apparent brightness may be implemented by measuring the current through the sense resistor 1116. The current through the sense resistor 1116 is substantially the same as the current through the lamp 712. The current through the sense resistor 1116 will produce a voltage across the sense resistor 1116 that is proportional to the lamp current. This voltage may be fed into an analog-to-digital converter (ADC) of the microcontroller 702*a*. The software running on the microcontroller 702*a* may now be used to determine a number of conditions of the operation of the fluorescent lamp 712. For example: (1) Has one of the filaments "burned out?" (2) What is the current through the filaments during preheat and is it excessive? (3) Is the lamp currently ON? And (4) what is the current across the lit lamp and is it at the desired current level?

The software program running in the microcontroller 702*a* may make decisions based upon the answers to these questions. If the lamp dimmer system is in $State_{High}$, then conditions 1 and 2 may be determined. If no current is detected, then it is an open circuit, and so the filaments must be 'burned out.' The value that the ADC 1118 of the microcontroller 702*a* produces will tell the software program the present value of the lamp filament current. If the lamp dimmer system is in $State_{Low}$, then conditions 3 and 4 may be determined. If no current is detected, then it is an open circuit, and so the lamp must be out. When lit, if the lamp current is outside where it is expected to be, then the ABDC can be adjusted to compensate. There are a number of feedback control techniques that may be implemented to stabilize the operation of the lamp brightness. A common technique known in the literature as PID control (proportional, Integral, Differential) may be implemented in software to maximize stability of the lamp brightness. A PID control loop may use this analog input representing lamp brightness to adjust the Apparent Brightness Duty Cycle (ABDC) so as to deliver a consistent perceived lamp brightness level.

That is, if the user of the lamp adjusts the lamp control to demand a 70% brightness level, the software program running on the microcontroller 702*a* may consider this as the demanded brightness level. A check of the current through the lamp will indicate the present apparent brightness of the lamp. If the values don't agree, the ABDC may be adjusted up or down to increase or decrease the Resultant Lamp Power (RLP), respectively. As the lamp increases or decreases in temperature because of its new brightness setting, the apparent brightness will drift. The feedback control via the microcontroller's software program will maintain the demanded brightness regardless of temperature transitions (e.g., drift or transients) in the lamp 712.

The Pulse Density Modulation (PDM) technique disclosed herein allows for easy implementation of a software feedback control program in the microcontroller 702*a*, according teachings of this disclosure. While maintaining the user desired brightness of the fluorescent lamp 712, this PDM technique may maintain temperature on the lamp filaments, thus extending the life the lamp filaments and also preventing the fluorescent lamp 712 from going out due to low filament temperature.

It is contemplated and within the scope of this disclosure, that the MOSFET drivers 704 may be driven directly from General Purpose I/O pins of the microcontroller 702. This eliminates the need for costly VCO circuits on or with the microcontroller. In addition, deadbanding may be implemented with a software program running in the microcontroller 702, thus eliminating the need for external logic circuits to perform this task. Furthermore, the lamp may be started via pre-heating the filaments and striking the gas ionization under control of the software program running in the microcontroller 702. The software program may dim the fluorescent lamp 712 via the PDM, and the number of brightness levels may be so numerous (very fine granularity) that 'sweeping' through them would appear as smooth as that seen with dimming of incandescent lamps. It is also contemplated and with the scope of this disclosure that a low pin count microcontroller may be used to implement the lamp dimmer system, resulting in quite a cost savings for the manufacturer as well as a wealth of reliability and functionality improvement to their products.

It is contemplated and within the scope of this disclosure that the digital device may be used, with appropriate software programming to: (1) active power factor correction (PFC) to increase lamp efficiency, (2) remote control protocols such as digital addressable lighting interface (DALI), IEEE 802.15.04 or Zigbee, and/or (3) battery charging for emergency lighting ballasts. The software program may be stored in non-volatile memory and may be implemented in the digital device as "firmware." A relatively inexpensive digital device, e.g., microcontroller, may run from an internal clock oscillator.

Figure 12:
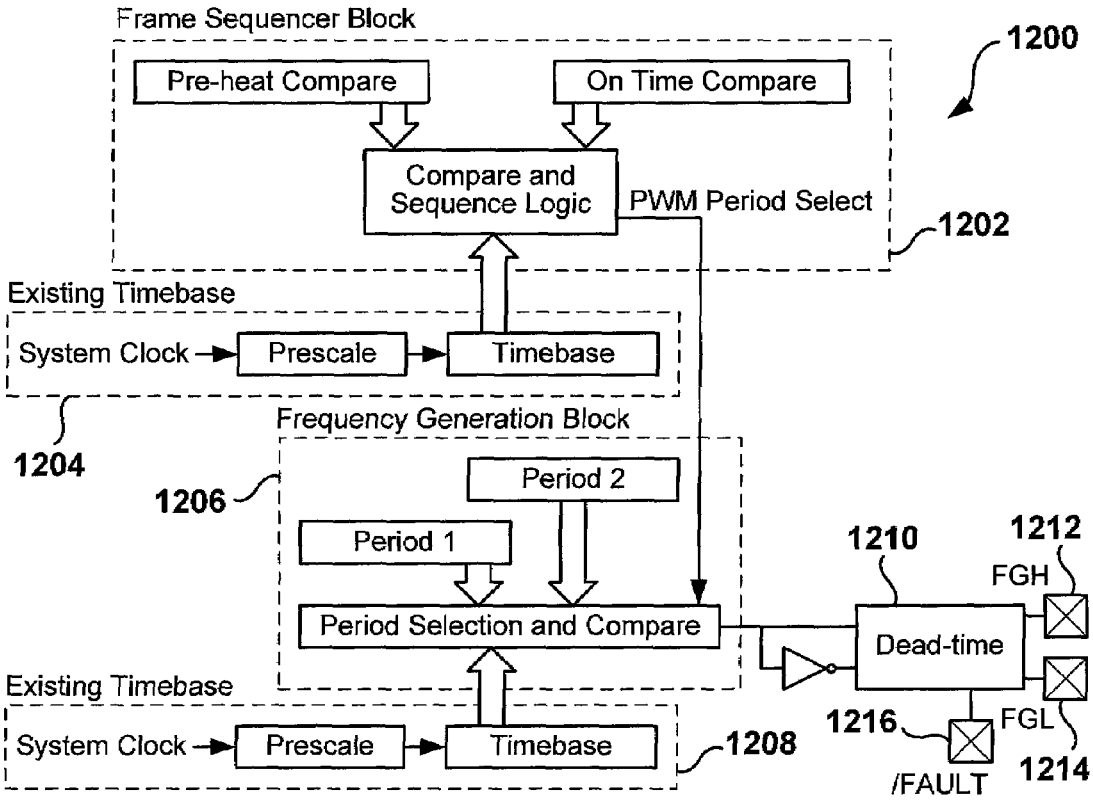
FIG. 12 illustrates a schematic block diagram of a predominately hardware implementation of a PDM generation peripheral for a lamp dimmer system, according to still another specific example embodiment of this disclosure.

Referring now to FIG. 12, depicted is a schematic block diagram of a predominately hardware implementation of a PDM generation peripheral for a lamp dimmer system, according to still another specific example embodiment of this disclosure. The predominately hardware implementation may be accomplished with a digital device, e.g., microcontroller, generally represented by the numeral 1200. The microcontroller may be used as a hardware peripheral that would automatically create the required control signals necessary to control operation and dimming of a fluorescent lamp(s) and require only minimum software program overhead. The pulse density modulation (PDM) scheme is relatively simple in concept and may easily be implemented in firmware in the microcontroller 1200. In addition, it may be beneficial from a cost and reliability standpoint to derive other features, e.g., active power factor correction (PFC) to increase lamp efficiency, remote control protocols such as DALI or Zigbee, and/or battery charging for emergency lighting ballasts, by utilizing the programmable capabilities of the microcontroller 1200.

The microcontroller 1200 may be configured for and comprise the following functional blocks. A Frame Sequencer Block 1202, a Frame Sequencer Timebase 1204, a Frequency Generator Block 1206, a Frequency Generator Timebase 1208, and a Dead-Time Generator 1210. The Dead-Time Generator 1210 may have FGH 1212 and FGL 1214 outputs and a /FAULT 1216 input.

Figure 13:
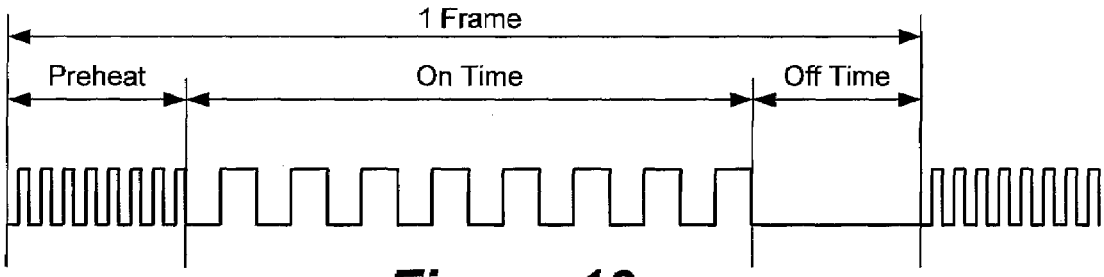
FIG. 13 illustrates a timing diagram for one frame of a PDM lamp driving frame.

The Frame Sequencer Timebase 1204 and Frequency Generator Timebase 1208 may be basic synchronous timers having a system clock input, a prescaler and a timebase. The Frame Sequencer Block 1202 may be used to specify the duration of each phase within a lamp driving frame, as shown in FIG. 13. The duration of the frame may be specified by the rollover period of the Frame Sequencer Timebase 1208. There are two compare registers which specify the end of the pre-heat ($State_{High}$-high-frequency-$F_{High}$) and the lamp-on ($State_{Low}$-resonant frequency-$F_{Low}$) periods. The lamp may be off ($State_{Off}$) for the remainder of the Frame Sequencer period.

The Frequency Generator Block 1206 may have two period registers so that two different frequencies may be generated. The Frame Sequencer Block 1202 sends control signals to the Frequency Generator Block 1206 that specify which period (frequency) to use. The first preheat frequency may be skipped if the Pre-heat Compare time is 0. The output will always be 0 (off) during the third phase of the frame. The Frequency Generator block 1206 will wait for the end of a period before switching to the next frequency state.

The Dead Time Generator 1210 may generate complementary output signals, FGH 1212 and FGL 1214, having switching delay between each transition. The Dead Time Generator 1210 may be used to drive a half-bridge inverter circuit, e.g., power MOSFETs 706 and 708. An asynchronous shutdown input /FAULT 1216 may also be provided for external hardware faults.

Figure 14:
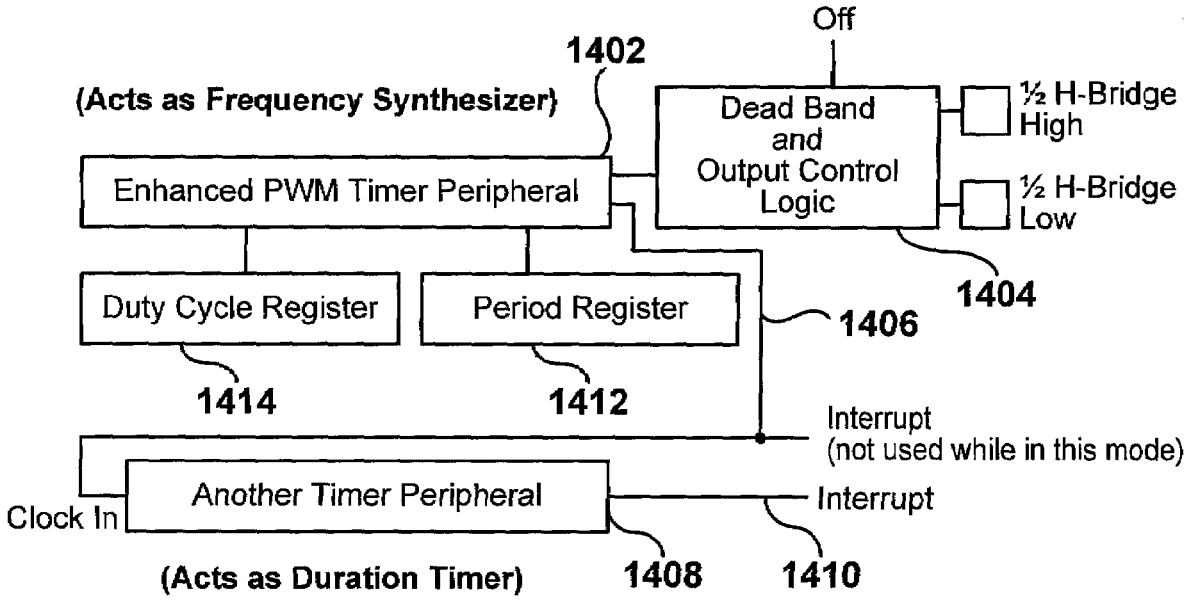
FIG. 14 illustrates a schematic block diagram of a software assisted PDM generation peripheral for a lamp dimmer system, according to yet another specific example embodiment of this disclosure.

Referring now to FIG. 14, depicted is a schematic block diagram of a software assisted PDM generation peripheral for a lamp dimmer system, according to yet another specific example embodiment of this disclosure. The amount of hardware required to implement a PDM generation peripheral may be cost prohibitive. If this is the case, a 'software assisted' version of the PDM generation peripheral may be implemented as shown in FIG. 14.

The PDM generation peripheral may be easily and inexpensively implemented using currently available microcontroller hardware. An Enhanced Capture/Compare/PWM (ECCP) module with timebase 1402 and output logic 1404 may be used to generate the frequency output to the lamp ballast inverter, e.g., power MOSFETs 706 and 708. The ECCP timebase interrupt signal 1406 may be routed internally to a second timebase 1408 and used to increment that timebase 1408. The second timebase 1408 keeps track of the time spent in each frequency state (see FIG. 13). Therefore, the central processing unit (CPU) of the microprocessor is only interrupted when the second timebase 1408 overflows (interrupt 1410). This process is analogous to a microcontroller motor control where the CPU only needs to be interrupted at commutation events, which occur at a much lower rate than does the PWM frequency. A new period register 1412 and duty cycle register 1414 may be loaded at each interrupt event of the second timebase 1408. The output logic 1404 may have the ability to be placed in the 'OFF' state and still keep the ECCP timebase 1402 running. This allows for timing of the 'OFF' state ($State_{Off}$) by software control from the microcontroller.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. A method for controlling dimmable electronic lighting ballasts using pulse density modulation, said method comprising the steps of:

generating a first plurality of pulses operating at a first number of pulses per second during a filament preheating time period, wherein filaments of a fluorescent lamp are heated thereby, wherein the first number of pulses per second is above a series resonant frequency of a dimmable electronic lighting ballast and the fluorescent lamp;

generating a second plurality of pulses operating at a second number of pulses per second during a lamp-on time period, wherein the second number of pulses per second is less than the first number of pulses per second and whereby gas in the fluorescent lamp is ionized when the second plurality of pulses is applied thereto;

generating no pulses during a lamp-off time period;

generating the first plurality of pulses for a filament heating time period after the lamp-off time period; and the lamp-on, lamp-off and filament heating time periods are within a lamp dimming frame time period that repeats during dimming of the fluorescent lamp.

2. The method according to claim 1, wherein the lamp-off and filament heating time periods are substantially 100 percent of the lamp dimming frame time period when the fluorescent lamp is at a minimum brightness.

3. The method according to claim 1, wherein the lamp dimming frame time period is less than or equal to 1/30 of a second.

4. The method according to claim 1, wherein the filament heating time period is enough of a portion of the lamp dimming frame time period to keep the fluorescent lamp filaments heated.

5. The method according to claim 1, further comprising the step of measuring current through the fluorescent lamp.

6. The method according to claim 5, further comprising the step of determining conditions of the fluorescent lamp from the measured current.

7. The method according to claim 6, wherein the conditions of the fluorescent lamp are selected from the group consisting of filament burnout, excessive filament current during preheat, and current through the fluorescent lamp when the gas therein is ionized.

8. The method according to claim 5, further comprising the step of adjusting the lamp-on and the lamp-off time periods of the lamp dimming frame time period so as to keep the measured current through the fluorescent lamp at a desired value.

9. The method according to claim 1, further comprising the steps of adjusting the lamp-off and filament heating time periods during the lamp dimming frame time period so as to keep the filaments of the fluorescent lamp at a desired temperature.

10. The method according to claim 1, further comprising the step of correcting power factor.

11. The method according to claim 1, further comprising the step of remotely controlling the lamp-on, lamp-off and filament heating time periods so as to remotely control the fluorescent lamp light output.

12. The method according to claim 11, wherein the step of remotely controlling comprises the step of remotely controlling with a digital addressable lighting interface (DALI) protocol.

13. The method according to claim 11, wherein the step of remotely controlling comprises the step of remotely controlling with a Zigbee protocol.

14. The method according to claim 11, wherein the step of remotely controlling comprises the step of remotely controlling with an IEEE 802.15.4 protocol.

15. The method according to claim 1, further comprising the step of controlling a battery charger for emergency lighting.

16. A dimmable fluorescent lamp system having an electronic lighting ballast using pulse density modulation for controlling the amount of light produced by the fluorescent lamp, said system comprising:

a digital device having a first output and a second output;

a first power switch having a control input coupled to the first output of the digital device;

a second power switch having a control input coupled to the second output of the digital device;

an inductor coupled to the first and second power switches, wherein the first power switch couples the inductor to a supply voltage, the second power switch couples the inductor to a supply voltage common, and the first and second power switches decouple the inductor from the supply voltage and supply voltage common, respectively;

a direct current (DC) blocking capacitor coupled to the supply voltage common;

a fluorescent lamp having first and second filaments, wherein the first filament is coupled to the inductor and the second filament is coupled to the DC blocking capacitor; and a filament capacitor coupling together the first and second filaments of the fluorescent lamp;

wherein the digital device digitally generates:

a first plurality of pulses operating at a first number of pulses per second during a filament preheating time period, wherein the first and second filaments of the fluorescent lamp are heated thereby, wherein the first number of pulses per second is above a series resonant frequency of the inductor and the filament capacitor, a second plurality of pulses operating at a second number of pulses per second during a lamp-on time period, wherein the second number of pulses per second is less than the first number of pulses per second and whereby gas in the fluorescent lamp is ionized when the second plurality of pulses is applied thereto, no pulses during a lamp-off time period, the first plurality of pulses for a filament heating time period after the lamp-off time period; and the lamp-on, lamp-off and filament heating time periods are within a lamp dimming frame time period that repeats during dimming of the fluorescent lamp.

17. The system according to claim 16, wherein the lamp-off and filament heating time periods are substantially 100 percent of the lamp dimming frame time period when the fluorescent lamp is at a minimum brightness.

18. The system according to claim 16, wherein the lamp dimming frame time period is less than or equal to 1/30 of a second.

19. The system according to claim 16, wherein the filament heating time period is enough of a portion of the lamp dimming frame time period to keep the fluorescent lamp first and second filaments heated.

20. The system according to claim 16, further comprising a fluorescent lamp current measurement resistor coupled between the DC blocking capacitor and the supply voltage common, wherein the fluorescent lamp current measurement resistor is used for measuring the fluorescent lamp current.

21. The system according to claim 20, wherein a voltage across the fluorescent lamp current measurement resistor is coupled to an analog input of the digital device.

22. The system according to claim 21, wherein the digital device adjusts the lamp-on and lamp-off time periods so as to keep the fluorescent lamp current at a desired value.

23. The system according to claim 16, wherein the digital device adjusts the lamp-off and filament heating time periods during the lamp dimming frame time period so as to keep the first and second filaments at a desired temperature.

24. The system according to claim 16, wherein the digital device is selected from the group consisting of microprocessor, microcontroller, application specific integrated circuit (ASIC), and programmable logic array (PLA).

25. The system according to claim 16, wherein the digital device comprises:

a frame sequencer block;

a frame sequencer time base;

a pulse generator block;

a pulse generator time base; and a dead-time generator;

wherein the frame sequencer block determines the lamp-on, lamp-off and filament heating time periods, the pulse generator block determines the first and second plurality of pulses, and the dead-time generator prevents the first and second power switches from both being on at the same time.

26. The system according to claim 16, wherein the digital device is controlled with a software program.

* * * * *